US005765239A

United States Patent [19]

Moses

[11] Patent Number: 5,765,239

[45] Date of Patent: Jun. 16, 1998

[54] CHILDREN'S FURNITURE

[76] Inventor: Tony G. Moses, 14042 Roscoe Blvd., Van Nuys, Calif. 91402

[21] Appl. No.: 853,248

[22] Filed: May 9, 1997

[51] Int. Cl.[6] ..... A47C 19/22; A47D 11/00

[52] U.S. Cl. ..... 5/2.1; 5/93.2; 5/308; 312/107

[58] Field of Search ..... 312/107, 108, 312/111; 5/2.1, 93.2, 308

[56] References Cited

U.S. PATENT DOCUMENTS

| | | | |
|---|---|---|---|
| 1,297,144 | 3/1919 | Giordane | 5/2.1 |
| 2,787,007 | 4/1957 | Erdkamp . | |
| 2,899,691 | 8/1959 | Davis et al. . | |
| 3,241,885 | 3/1966 | Deaton . | |
| 3,338,648 | 8/1967 | Bannister . | |
| 3,811,728 | 5/1974 | Redemske | 5/2.1 X |
| 3,841,727 | 10/1974 | Peng | 5/2.1 X |
| 4,109,328 | 8/1978 | Mason . | |
| 4,259,755 | 4/1981 | Hollander . | |
| 4,361,919 | 12/1982 | Hull | 5/93.2 |
| 5,067,183 | 11/1991 | Urgiola | 5/93.2 X |
| 5,147,120 | 9/1992 | Ray | 312/107 X |
| 5,176,435 | 1/1993 | Pipkens . | |
| 5,423,597 | 6/1995 | Rogers . | |

FOREIGN PATENT DOCUMENTS

| | | |
|---|---|---|
| 162779 | 5/1921 | United Kingdom . |
| 2 137 082 | 10/1984 | United Kingdom . |

*Primary Examiner*—Michael F. Trettel
*Attorney, Agent, or Firm*—Richard C. Littman

[57] ABSTRACT

Modular children's furniture with components including a planar panel that can serve as a base and/or a top, a stackable cube, a stackable rectangular cubicle, a drawer component, a shelf, and a playpen. The planar panel with rubber caster wheels is a base upon which the modular components are stacked. The planar panel without caster wheels is a countertop and caps the modular components. Each cube and cubicle has a hingedly connected panel that functions as a door or lid. Also included are a stackable drawer component and a shelf component. The playpen includes two side panels that are made of a plastic coated wire mesh. The playpen also has two solid side panels that can be attached to a standard bedframe and thus serve as a headboard.

20 Claims, 6 Drawing Sheets

CHILDREN'S FURNITURE

CROSS-REFERENCE TO RELATED APPLICATION

This application claims the benefit of U.S. Provisional Pat. application Ser. No. 60/020,792, filed Jun. 27, 1996.

BACKGROUND OF THE INVENTION

1. Field of the Invention

The present invention is directed to furniture in general and, more specifically, to modular children's furniture, having planar bases with recessed rubber caster-wheels, a planar top, a cube, a rectangular cubicle, a drawer component, a shelf, and an adaptable playpen. The bases are configured in differing lengths and widths in order to accommodate a variety of modular configurations. The cube and cubicle components include hinged doors. The playpen has two solid wall panels and two plastic coated wire mesh panels, the solid panels being adaptable to a standard bedframe. Further, the present invention is made of wood, or a similarly durable material, and all surfaces have an attractive stain finish.

2. Description of the Related Art

The present invention imparts great versatility and adaptability in modular furniture that heretofore has been unavailable, especially in regard to furniture suiting the needs of infants and growing children. The modular components of the present invention are regrouped variously to build and assemble modular furniture that will continue to serve different and changing needs of growing children.

Modular means: "constructed with independent standardized units for use together." Indeed, the present invention is modular, unlike previously known and described furniture, each component not only having independent utility, but also being uniquely configured so that each modular component can be adapted to another component in an infinite variety of configurations, thus to create a functional whole that is greater than the sum of the individual parts.

Numerous U.S. and foreign patents describe and disclose articles of furniture having numerous parts that can be assembled in a variety ways; no matter how the parts of the furniture are assembled, however, the result invariably is a bed, a desk, a playpen, a cabinet. In direct contradistinction thereto, the present invention is unique—each component or module has its own inherent function as an article of furniture, independent of its potential interrelation with other modular components. For example, the hinged cube and the rectangular cubicle can serve as hampers or chests. The modular drawer-and-case is an attractive and useful feature alone. Further, the bases are convenient platforms, and the tops are portable and storable counters.

U.S. Pat. No. 2,787,007 issued to Erdkamp on Apr. 2, 1957, discloses a baby and youth bed assembly having a plurality of units that can be adapted to make a playpen with a dresser cabinet. No matter how the parts are assembled, and no matter what the final configuration or spacial orientation, the sum of the parts is still a playpen. The parts cannot be assembled to provide, for instance, a table. Similarly, U.S. Pat. No. 2,809,691 issued to Davis et al. on Aug. 18, 1959, describes a dual sofa-bed assembly, the type commonly found in many American vacation homes in the 1970's. Though this device provides the user a certain degree of flexibility, regarding assembly and orientation, the assembled sofa is still fundamentally a pair of twin beds and an end table.

The assembly disclosed in U.S. Pat. No. 3,241,885 issued to Deaton on Mar. 22, 1966, is an expandable sofa, end table and coffee table. Simply altering the manner of assembly yields no other versatility or variety of function beyond that which is already inherent to the function of a sofa and a table. Furthermore, the unassembled parts of an article of furniture generally have no utility until assembled. In contrast, the present invention provides modular components that have a dual aspect of utility: 1) the modular components of the present invention have utility as independent items of furniture; and 2) the modular components are the building blocks for articles of furniture that do not have a predetermined function.

Other U.S. patents have disclosed furniture that have similar structural limitations; that is to say, even though the furniture can be assemble in numerous fashions, its basic function cannot be altered. U.S. Pat. No. 3,338,648 issued to Bannister on Aug. 29, 1967, discloses a bunk-bed/desk/cabinet suitable for living quarters that have limited space, such as a college dormitory. Convenient, versatile and admittedly adaptable, but still, unlike the present invention, the parts of a bunk-bed cannot be utilized for any purpose other than for the assembly of a bunk-bed. Conversely, the user of the independent modular components of the present invention can regroup the same modular, components differently, to obtain modular furniture that serves different and changing needs. Similarly, U.S. Pat. No. 4,109,328 issued to Mason on Aug. 29, 1978, describes a bunk-bed that does not teach that independently functioning units can be grouped together to form different functions.

Several U.S. patents describe uses that the present invention could conceivable serve; however, none of these devices teach that the same independent modular elements can be recombined by the user to fulfill a different purposes and produce new results. In essence, the user becomes the decision-maker regarding the ultimate function and purpose of the assemble structure. U.S. Pat. No. 4,259,755 issued to Hollander on Apr. 7, 1981, describes an expandable bedframe with multiple compartments. Though the present invention might be utilized to form a bedframe with multiple compartments, the user is not needlessly constrained to a single adaptation. Similarly, U.S. Pat. No. 5,423,597 issued to Rogers on Jun. 13, 1998, discloses the interchangeable parts for children's school chair and desk. And again, U.K. Pat. App. No. 2,137,082 published by Geddis on Oct. 3, 1984, discloses a bed, a desk, a cabinet, a shelf, and a bracket. Unlike the previously disclosed articles of furniture, the purpose and function of the assembled structure of the present invention, is not predetermined. The present invention is a unique combination of modular elements that can be assembled in any number of configurations to provide an infinite number of functions.

U.S. Pat. No. 5,176,435 issued to Pipkens on Jan. 5, 1993, discloses furniture for hotels with parts that can be replaced in the event of excessive wear or damage by hotel guests. The modular elements of the present invention are not replacement parts for a particular article of furniture, but rather are creative building blocks, adaptable to an infinite number of structures and purposes.

Finally, British Provisional Spec. No. 162,779 issued to Bender on May 3, 1921, discloses an improved construction for desks, counters and tables, whereby articles of furniture can be constructed from parts that can be rearranged to enhance adaptability of the particular article of furniture. Like previously discussed articles of furniture, the use, purpose, and function of the desks, counters and tables are predetermined, and unlike the modular elements of the present invention, the unassembled parts serve no independent function other than as assembly components.

Unlike currently available furniture described as modular, the present invention is uniquely configured to allow the user to become the ultimate decision maker regarding the final assembled use. Furthermore, unlike existing furniture, the component modules of the present invention have inherent function as items of furniture.

None of the above inventions and patents, taken either singly or in combination, is seen to describe children's modular furniture as claimed. Thus, modular children's furniture solving the aforementioned problems is desired.

SUMMARY OF THE INVENTION

The present invention is modular children's furniture made up of a base with recessed rubber caster-wheels, a top, a cube with a hinged door, a case with a drawer, a rectangular cubicle having a hinged rectangular door, a shelf and an adaptable playpen.

The cube component is specifically configured so that the hinged face can be opened to the side as a door or lifted as a lid. The cube can serve alone as a hamper or a chest, and as a component with other modular components. The cube may include shelves. Similarly, the rectangular cubicle is configured so that the rectangular hinged door can be opened to the side as a door or lifted up as a lid. The rectangular cubicle can also serve as a chest or a hamper, and can include shelves. The cube and the rectangular cubicle can serve as a pedestal when used in conjunction with other cubes, cubicles and modular components.

The drawer component includes a case with runners and a drawer that is slidably mounted therein with tracks. The drawer component further includes a child proof latch. The drawer components are stackable, as are the cube and rectangular cubicle. Individually, the drawer components can be made/used as a chest or table top storage container. In conjunction with other components the drawer and case can be stacked to form a pedestal, a file cabinet, or an armoire.

The top and base are adapted from a planar panel. The top is a planar panel without caster wheels and the base is a planar panel with rubber caster wheels. The planar panels are configured in different lengths and widths in order to accommodate a variety of configurations and provide the user greater flexibility and versatility. Used alone the planar panels with caster wheels form a convenient rolling stand or platform. Used in conjunction with other modular components the planar bases furnish a movable stand upon which cubes, cubicles, playpens, and drawer components can be arranged. Similarly, the planar tops provide a convenient countertop. The planar tops are configured to provide versatility and flexibility.

The shelf component includes a base, a top, two side panels, a rear panel, and a plurality of plastic coated wire meshed shelves. The shelves are made of a mesh material to enhance air circulation, and reduce weight and expense.

Finally, to further enhance versatility and adaptability for an infant, the present invention includes a playpen having two solid panels and two plastic covered wire panels. When the infant becomes too large for the playpen, the solid side panels of the playpen are configured to be easily mounted on a standard twin bedframe.

The present invention provides versatility and adaptability in modular furniture that heretofore has been unavailable, especially in regard to growing children. Further, the present invention is made of wood, or a similarly durable material, and all surfaces have an attractive stain finish.

Accordingly, it is a principal object of the invention to provide modular components that can be assembled into furniture for children. The components including a wheeled base, a top, a stackable cube having a hinged face, a stackable rectangular cubicle also having a hinged rectangular face, a case with a drawer, a shelf, and a playpen.

It is another object of the invention to provide modular furniture for children that can be used separately or in conjunction with other components. When the components are used in conjunction with other components it is specifically intended that the functions and purposes should not be limited, but instead adaptable to a variety of uses and changing conditions. Indeed it is intended that the present invention provide adaptability for the growing child.

It is an object of the invention to provide improved elements and arrangements thereof in an article for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
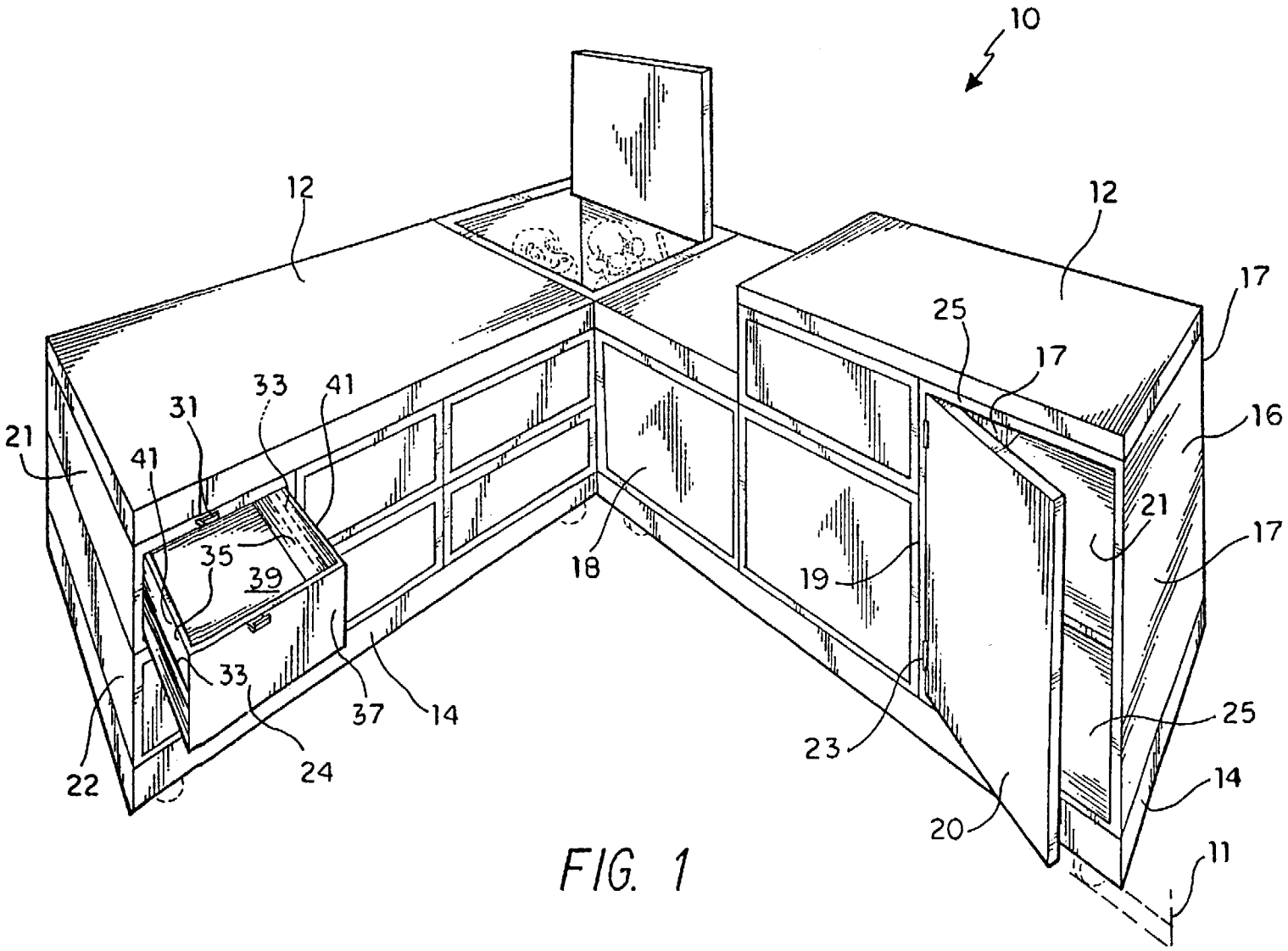
FIG. 1 is an environmental perspective view of modular children's furniture showing a possible configuration of the modular components.
Figure 6:
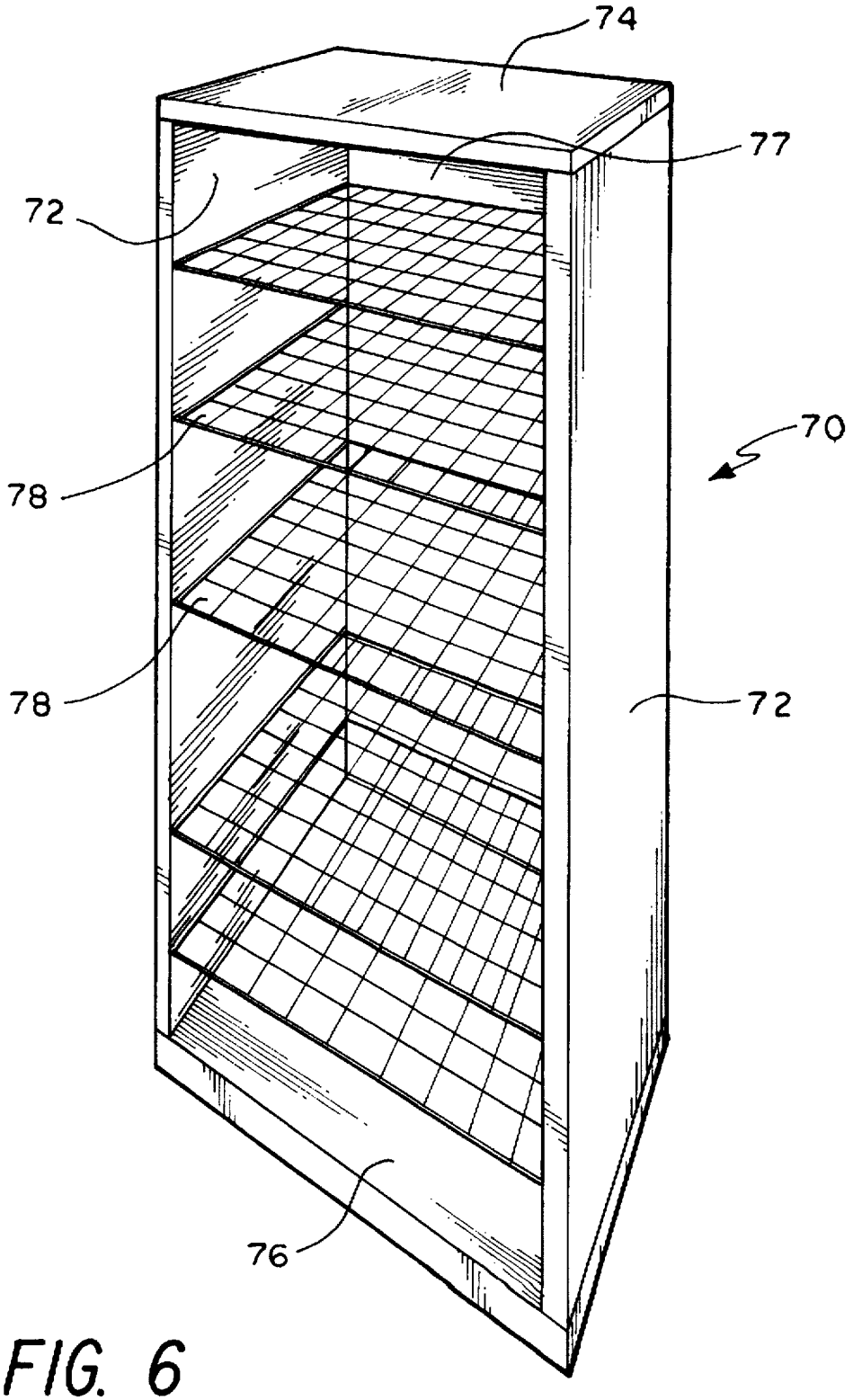
FIG. 6 is a perspective view of the shelf component.
Figure 7:
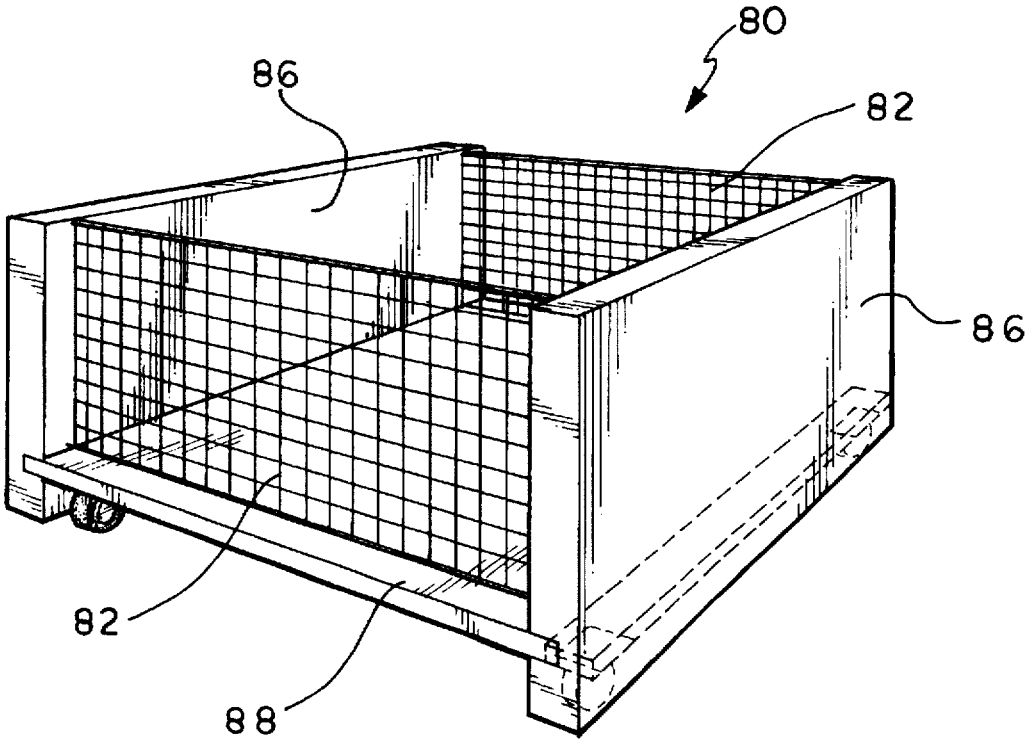
FIG. 7 is a perspective view of the adaptable playpen.

As depicted in FIG. 1 the children's modular furniture 10 includes a stackable cube 18, a stackable rectangular cubicle 16, a planar panel without caster wheels 12, a planar panel with casters 14, a stackable drawer component 22, a shelf component 70 (FIG. 6) and an adaptable playpen 80 (FIG. 7).

Figure 3:
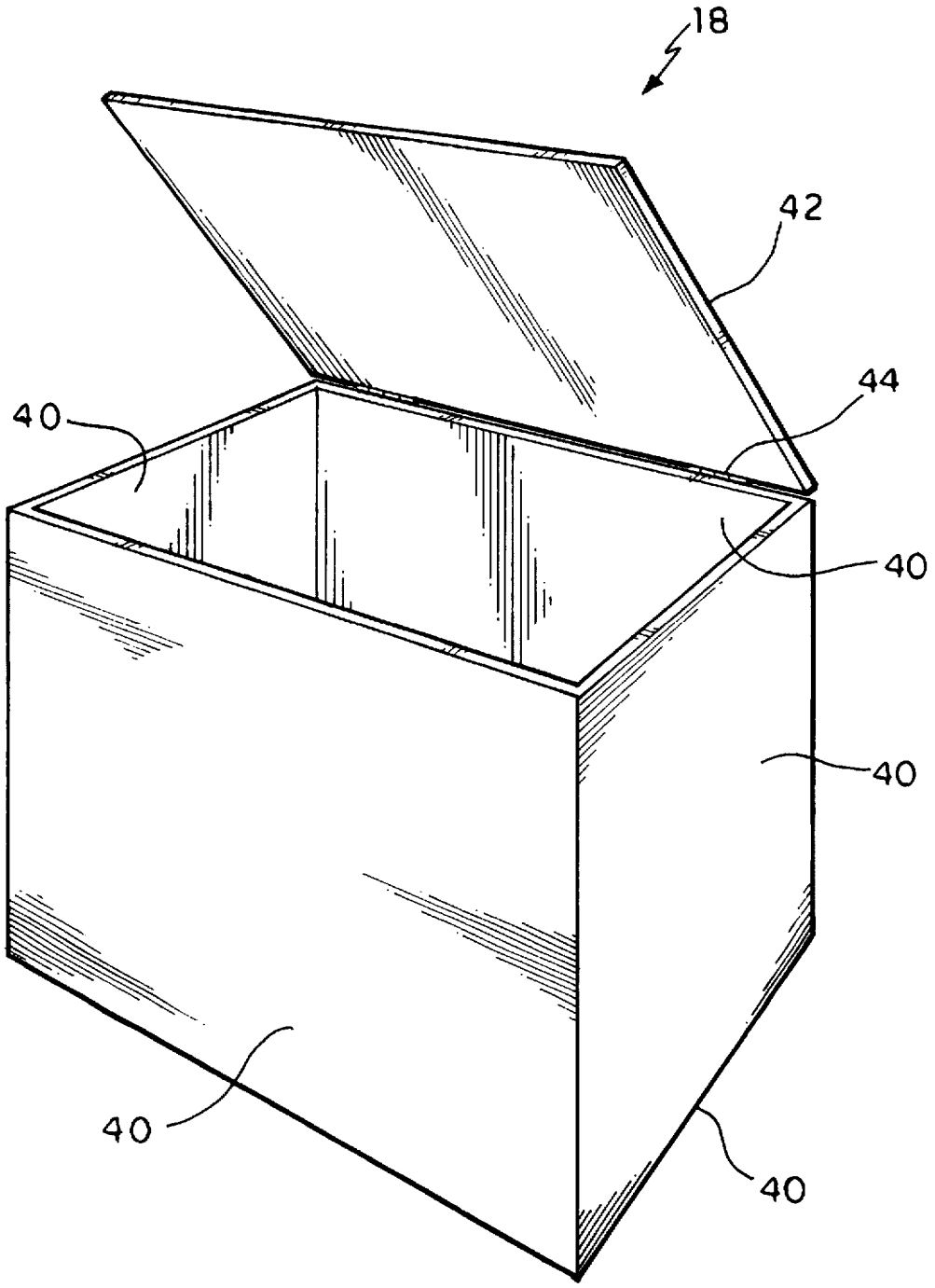
FIG. 3 is a perspective view of the cube component.

As depicted in FIG. 3, the stackable cube 18 has five squared walls 40, 40, 40, 40, 40, and a hinged door 42, mounted on a squared wall 40 by a hinge 44. The stackable cube component 18 can be stacked in a manner that permits the hinged door 42 to swing open to the side as a door, or up as a lid as depicted in FIG. 3. Alternatively, the stackable cube includes a plurality of shelves. (not shown). In the preferred embodiment the stackable cube component is made from wood and has a natural stain finish; however, alternatively any durable, child safe material, such as plastic is suitable. Furthermore, in the preferred embodiment the dimension of the square walls of the stackable cube is twenty-two inches; furthermore, the walls are two inches thick.

The stackable rectangular cubicle 16 (shown in FIG. 1), includes two squared sides 25, 25, three rectangular walls 17, 17, 17 and a hinged rectangular door 20, connected to a rectangular wall 19 along the length with a second hinge 23. The stackable rectangular cubicle 16 can be stacked in a manner which permits the rectangular door 20 to swing open to the side as depicted in FIG. 1, or else stacked to permit the rectangular door to lift as a lid. Alternatively, the stackable rectangular cubicle 16 includes a plurality of shelves 21. In the preferred embodiment the stackable rectangular cubicle component is made from wood and has a natural stain finish; however, alternatively any durable, child safe material, such as plastic is suitable. Furthermore, in the preferred embodiment the rectangular cubicle has two squared sides 25, 25 that are twenty-two inches by twenty-two inches. The rectangular walls 17, 17, 17 and the rectangular door 20 have a length of thirty-three inches and a width of twenty-two inches, the walls and door being two inches thick.

Figure 2:
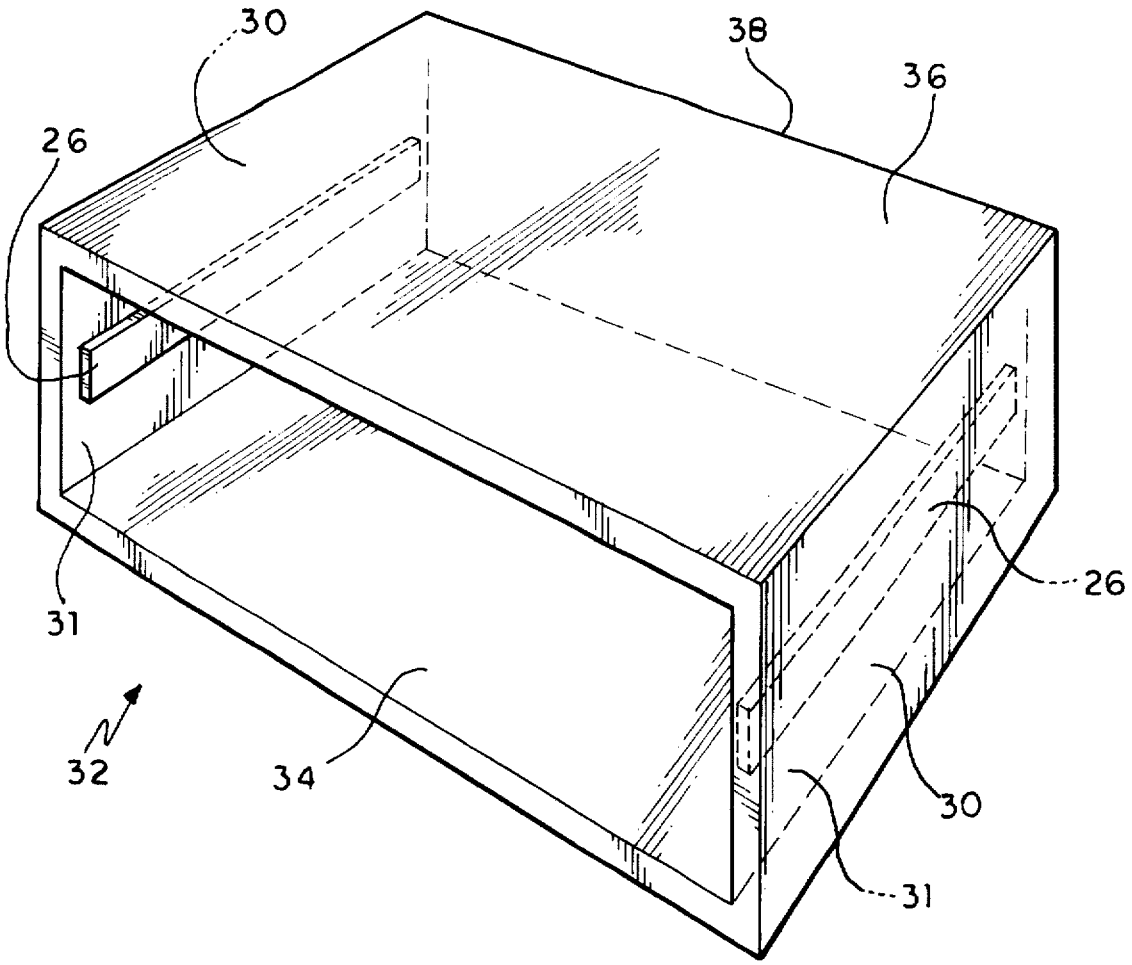
FIG. 2 is a perspective view of the case of the drawer component.

As depicted in FIGS. 1 and 2, present invention includes a stackable drawer component 22 having a case 32 and a drawer 24. FIG. 1 shows the drawer 24, and FIG. 3 illustrates the case 32 in which the drawer 24 is inserted. The case 32 includes a case top 36, a case bottom 34, two case sides 30, 30 and a case rear 38. The case side walls 30, 30 have interior surfaces 31, 31. Each interior surface has mounted thereon a runner 26, 26. The drawer 24, as shown in FIG. 1, has a drawer bottom 39, a drawer front 37, two drawer sides 35, 35, a drawer rear (not shown), and a child proof safety latch 31. The drawer sides 35, 35 each have an exterior surface 41, 41 whereupon are mounted a runner 33, 33 for slidably mounting the drawer 24 inside of the case 32.

In the preferred embodiment the stackable drawer component is made from wood and has a natural stain finish; however, alternatively any durable, child safe material, such as plastic is suitable. Furthermore, in the preferred embodiment the case rear is thirty-three inches by eleven inches and the case side walls are twenty-two inches by eleven inches the walls being one inch thick, further the drawer being specifically configured to be slidably mounted within the case.

Figure 4:
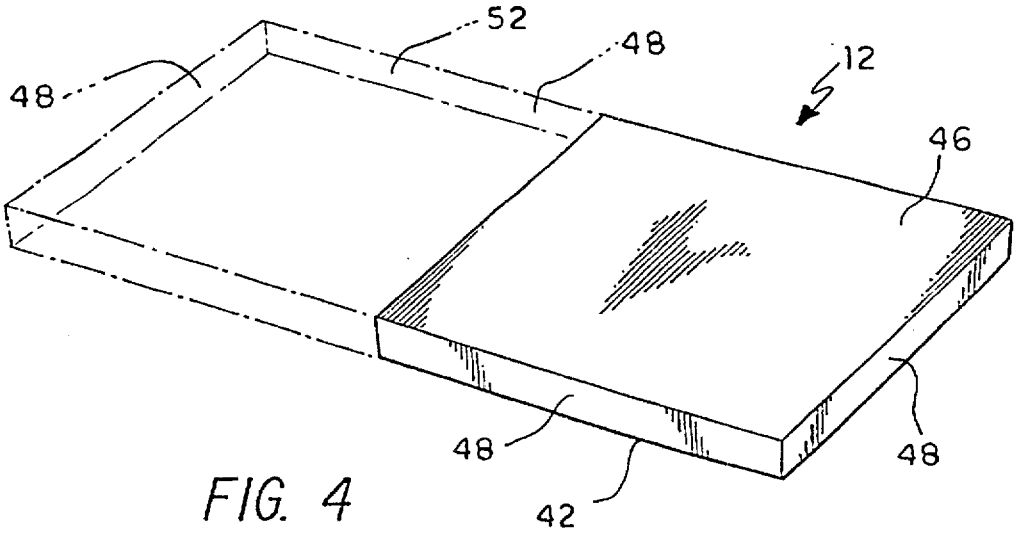
FIG. 4 is a perspective view of the planar panel without caster wheels, and an outline of an elongated embodiment of the planar panel.

As is seen in FIG. 4, the modular children's furniture includes a planar panel 12 without caster wheels, the planar panel having a counter top 46, side walls 48, 48, and an inferior surface 42 that caps the stackable modular components, as shown in FIG. 1. Furthermore, as indicated by outline 52, the planar panel has alternative embodiments. Specifically, the planar panel includes four sizes: 1) thirty-three inches by twenty two inches; 2) sixty-six inches by twenty-two inches; 3) ninety-nine inches by twenty-two inches; and 4) sixty-six inches by forty-four inches. The planar panel in all the embodiments is three inches thick. Furthermore, in the preferred embodiment the planar panel without casters is made from wood and has a natural stain finish; however, alternatively any durable, child safe material, such as plastic is suitable.

Figure 5:
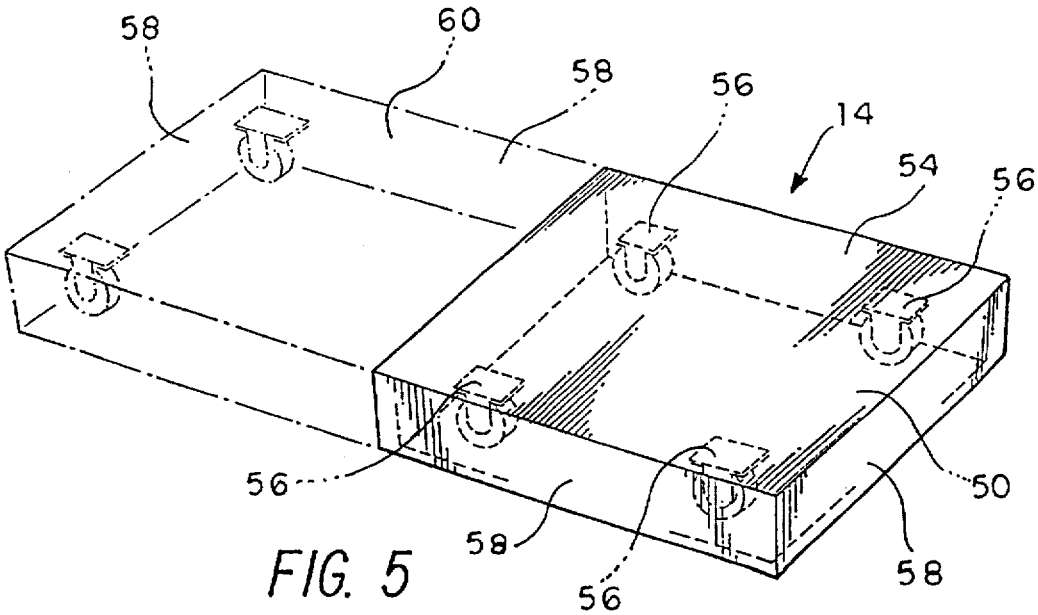
FIG. 5 is a perspective view of the planar panel with caster wheels, and an outline of an elongated embodiment of the panel.

As shown in FIG. 5, the modular children's furniture includes a stacking planar panel 14 with a plurality caster wheels 56, 56, 56, 56. The planar panels has a stacking surface 54, side walls 58, 58 and a lower surface 50 upon which are mounted a plurality of caster wheels 56. The modular components are conveniently stacked on the stackable surface of the planar panel with caster wheels, as depicted in FIG. 1. Furthermore, as depicted in outline 60, the planar panel has alternative embodiments. Specifically, the stacking planar panel includes four sizes: 1) thirty-three inches by twenty two inches having four recessed caster wheels; 2) sixty-six inches by twenty-two inches having six recessed caster wheels; 3) ninety-nine inches by twenty-two inches having six caster wheels; and 4) sixty-six inches by forty-four inches having eight rubber caster wheels; and 5) forty-four inches by forty-four inches having four rubber caster wheels and being specifically adaptable to a playpen. The planar panel in all the embodiments is three inches thick. Furthermore, in the preferred embodiment the planar panel with casters is made from wood and has a natural stain finish; however, alternatively any durable, child safe material, such as plastic is suitable. Finally, in the preferred embodiment the caster wheels are a rubber, such as hard rubber, and recessed so that the stackable planar panel is one half of an inch above the surface upon which it sits, as indicated by lines 11 in FIG. 1.

With reference to FIG. 6, the modular children's furniture includes a shelf component 70. The shelf has a shelf bottom 76, a shelf top 74, shelf side panels 72, 72, a shelf rear panel 77 and a plurality of plastic coated wire shelves 78, 78. In the preferred embodiment the shelf component is sixty-six inches high, twenty-two inches deep and twenty-two inches wide, the shelves being spaced at twelve inch intervals. Furthermore, the shelf top and bottom are three inches thick. In the preferred embodiment the shelf component is made from wood and has a natural stain finish; however, alternatively any durable, child safe material, such as plastic is suitable.

Finally, and as illustrated in FIG. 7, the modular children's furniture includes a playpen 80 adapted specifically from a planar base with casters that measures forty-four inches by forty-four inches. The playpen includes a base 88, two playpen solid side panels 86, 86, and two plastic coated wire panels 82, 82. The side panels 86, 86, 82, 82, are thirty-six inches high. In the preferred embodiment the shelf component is made from wood and has a natural stain finish; however alternatively, any durable, child safe material, such as plastic is suitable. Furthermore, solid playpen side panels are specifically adapted to permit the adaptation of the frame of a standard bed frame. Thus as a baby grows the playpen portion can be modified for continued use.

It is to be understood that the present invention is not limited to the embodiment described above, but encompasses any and all embodiments within the scope of the following claims.

I claim:

1. Children's furniture, comprising:

a plurality of stackable cubes, each cube having a hinged door and hinge means for hingedly mounting said door on its cube;

a plurality of stackable rectangular cubicles, each rectangular cubicle having a square cubicle top, a square cubicle bottom, three rectangular walls, a hinged rectangular door and second hinge means for mounting said rectangular door;

a plurality of stackable drawer components, each drawer component having a case and a drawer, said case having a case top, a case base, two case sides and a case rear, each of said case sides having an interior surface whereon are mounted a first and a second runner;

further said drawer of said draw component having a drawer base, a drawer front with a child proof latch means, a drawer rear, and two drawer sides, each of said drawer sides having an exterior surface whereon are mounted a first and second slidable track for mounting said drawer inside said case;

a playpen component having a bottom with an upper surface and an inferior surface, two plastic covered wire mesh sides, and two solid playpen side panels, there further being recessed caster wheels mounted upon said inferior surface;

a shelf component having a shelf bottom, two shelf component side panels, and a shelf solid rear panel, and further having a plurality of plastic coated wire mesh shelves; and a planar panel having a lower surface and a counter top/stacking surface, and including four side boards.

2. The children's furniture according to claim 1, wherein said base of said playpen is forty-four inches wide, forty-four inches long, and thirty-three inches high, and said two solid playpen side panels are adaptable to a standard twin-sized bed frame.

3. The children's furniture according to claim 1, wherein said shelf component is twenty-two inches wide, twenty-two inches long and sixty-six inches high.

4. The children's furniture according to claim 1, wherein said plurality of stackable cubicles each have a plurality of shelves.

5. The children's furniture according to claim 1, wherein said plurality of stackable rectangular cubicles each have a plurality of shelves.

6. The children's furniture according to claim 1, wherein said planar panel have a plurality of recessed caster means mounted on said lower surface of said planar panel.

7. The children's furniture according to claim 6, wherein said plurality of recessed rubber caster means comprise rubber wheels extended beneath said lower surface of said planar panel by one-half inch.

8. The children's furniture according to claim 1, wherein said plurality of stackable cubes have walls, each of which are two inches thick and with a surface dimension of twenty-two inches by twenty-two inches.

9. The children's furniture according to claim 1, wherein said plurality of stackable rectangular cubicles have walls that are two inches thick, said square cubicle top and said square cubicle bottom being twenty-two inches by twenty-two inches, and said three rectangular walls being thirty-three inches by twenty-two inches, and said hinged rectangular door being thirty-three inches by twenty-two inches.

10. The children's furniture according to claim 1, wherein said planar panel is three inches thick and has a length of thirty-three inches and a width of twenty-two inches.

11. The children's furniture according to claim 10, wherein said plurality of recessed rubber caster means are four.

12. The children's furniture according to claim 1, wherein said planar panel is three inches thick and has a length of sixty-six inches and a width of twenty-two inches.

13. The children's furniture according to claim 12, wherein said plurality of recessed rubber caster means are six.

14. The children's furniture according to claim 1, wherein said planar panel is three inches thick and has a length of ninety-nine inches and a width of twenty-two inches.

15. The children's furniture according to claim 14 wherein said plurality of recessed rubber caster means are six.

16. The children's furniture according to claim 1, wherein said planar panel is three inches thick and has a length of sixty-six inches and a width of forty-four inches.

17. The children's furniture according to claim 16, wherein said plurality of recessed rubber caster means are eight.

18. The modular children's furniture according to claim 1, is made of wood and has a stained finish.

19. Children's furniture, comprising:

a plurality of stackable cubes, each cube having a hinged door;

a plurality of stackable rectangular cubicles, each rectangular cubicle having a square cubicle top, a square cubicle bottom, three rectangular walls, and a hinged rectangular door;

a plurality of stackable drawer components, each drawer component having a case and a drawer, said case having a case top, a case base, two case sides and a case rear, each of said case sides having an interior surface whereon are mounted a first and a second runner;

a playpen component having a bottom with an upper surface and an inferior surface, two mesh sides, and two solid playpen side panels;

a shelf component having a shelf bottom, two shelf component side panels, and a shelf solid rear panel, and further having a plurality of shelves; and a planar panel having a lower surface and a counter top/stacking surface, and including four side boards.

20. The children's furniture according to claim 19, wherein said plurality of stackable cubicles each have a plurality of shelves.

* * * * *